US010476173B2

(12) United States Patent
Daojian et al.

(10) Patent No.: US 10,476,173 B2
(45) Date of Patent: Nov. 12, 2019

(54) ANTENNA ELEMENT USED FOR MULTI-BAND ANTENNA DUAL POLARIZATION

(71) Applicant: HUAWEI TECHNOLOGIES CO., LTD., Shenzhen, Guangdong (CN)

(72) Inventors: Dingjiu Daojian, Munich (DE); Weihong Xiao, Shenzhen (CN); Ye Yang, Xi'an (CN); Chunbin Li, Xi'an (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/906,637

(22) Filed: Feb. 27, 2018

(65) Prior Publication Data

US 2018/0191083 A1 Jul. 5, 2018

Related U.S. Application Data

(63) Continuation of application No. PCT/CN2015/088557, filed on Aug. 31, 2015.

(51) Int. Cl.
*H01Q 21/24* (2006.01)
*H01Q 9/28* (2006.01)
(Continued)

(52) U.S. Cl.
CPC ..... *H01Q 21/24* (2013.01); *H01Q 1/246* (2013.01); *H01Q 1/52* (2013.01); *H01Q 1/521* (2013.01);
(Continued)

(58) Field of Classification Search
CPC ..... H01Q 1/52; H01Q 1/246; H01Q 1/521; H01Q 21/24; H01Q 21/26; H01Q 5/30; H01Q 5/328; H01Q 9/28; H01Q 9/04
(Continued)

(56) References Cited

U.S. PATENT DOCUMENTS 4,686,536 A 8/1987 Allcock
5,977,931 A * 11/1999 Openlander ..... H01Q 1/36 29/600
(Continued)

FOREIGN PATENT DOCUMENTS

CN 101847783 A 9/2010
CN 102800965 11/2012
(Continued)

OTHER PUBLICATIONS

International Search Report, dated Jun. 1, 2016, in International Application No. PCT/CN2015/088557 (5 pp.).
(Continued)

*Primary Examiner* — Lam T Mai
(74) *Attorney, Agent, or Firm* — Kilpatrick Townsend & Stockton LLP

(57) ABSTRACT

Antenna elements (101, 102) used for multi-band antenna dual polarization include: four radiating elements (201), a balun element configured to feed power to the radiating elements (201), and a fastening plate (202) configured to fasten the balun element. The balun element includes two dielectric plates (203). Two signal transmission units (301), one feeding unit (401), and two filtering units (402) are printed on each dielectric plate (203). An LC resonant energy storage structure is constructed on the balun element by using the filtering units (402), and decoupling on a specific frequency band can be implemented by adjusting the filtering unit (402). Therefore, even if the antenna elements (101, 102) are applied to a scenario in which elements on different frequency bands work collaboratively, radiating elements (201) on different frequency bands are not coupled electromagnetically and strongly when the radiating elements are arranged closely.

9 Claims, 9 Drawing Sheets

(51) Int. Cl.

| | |
|---|---|
| ***H01Q 21/26*** | (2006.01) |
| ***H01Q 9/04*** | (2006.01) |
| ***H01Q 1/52*** | (2006.01) |
| ***H01Q 5/328*** | (2015.01) |
| ***H01Q 1/24*** | (2006.01) |
| ***H01Q 5/42*** | (2015.01) |
| ***H01Q 5/30*** | (2015.01) |

(52) U.S. Cl.
CPC ..... *H01Q 5/30* (2015.01); *H01Q 5/328* (2015.01); *H01Q 5/42* (2015.01); *H01Q 9/04* (2013.01); *H01Q 9/28* (2013.01); *H01Q 21/26* (2013.01)

(58) Field of Classification Search
USPC ..... 343/795
See application file for complete search history.

(56) References Cited

U.S. PATENT DOCUMENTS

| | | | | |
|---|---|---|---|---|
| 6,072,439 | A * | 6/2000 | Ippolito | H01Q 1/246 343/795 |
| 2005/0200554 | A1* | 9/2005 | Chau | H01Q 1/2233 343/895 |
| 2006/0152426 | A1* | 7/2006 | McGrath | H01Q 1/38 343/770 |
| 2007/0262914 | A1* | 11/2007 | Chau | H01Q 1/362 343/895 |
| 2008/0079644 | A1* | 4/2008 | Cheng | H01Q 13/10 343/769 |
| 2012/0068892 | A1* | 3/2012 | Shtrom | H01Q 9/26 343/702 |
| 2013/0314292 | A1 | 11/2013 | Maley | |
| 2014/0049439 | A1 | 2/2014 | Ho | |
| 2014/0111396 | A1 | 4/2014 | Hyjazie et al. | |
| 2014/0139387 | A1 | 5/2014 | Jones et al. | |
| 2014/0139395 | A1* | 5/2014 | Solondz | H01Q 1/246 343/872 |
| 2015/0295313 | A1 | 10/2015 | Zimmerman et al. | |
| 2016/0254594 | A1 | 9/2016 | Jones et al. | |
| 2017/0179596 | A1* | 6/2017 | Diaz | H01Q 3/46 |
| 2017/0294701 | A1* | 10/2017 | Trogan | H02J 50/20 |
| 2017/0338571 | A1* | 11/2017 | Moosbrugger | H01Q 25/001 |

FOREIGN PATENT DOCUMENTS

| | | | |
|---|---|---|---|
| CN | 202856894 | | 4/2013 |
| CN | 103840254 | | 6/2014 |
| CN | 104022354 | | 9/2014 |
| EP | 1566857 | A1 | 8/2005 |
| JP | 2013026707 | A | 2/2013 |
| KR | 1020120037763 | | 4/2012 |

OTHER PUBLICATIONS

International Search Report, dated Jun. 1, 2016, in International Application No. PCT/CN2015/088557 (4 pp.).
Extended European Search Report, dated Jun. 26, 2018, in European Application No. 15902533.7 (9 pp.).
Office Action, dated Apr. 24, 2019, in Chinese Application No. 201580028850.5 (7 pp.).

* cited by examiner

ANTENNA ELEMENT USED FOR MULTI-BAND ANTENNA DUAL POLARIZATION

CROSS-REFERENCE TO RELATED APPLICATIONS

This application is a continuation of International Application No. PCT/CN2015/088557, filed on Aug. 31, 2015, the disclosure of which is hereby incorporated by reference in its entirety.

TECHNICAL FIELD

The present invention relates to the field of radio communication technologies, and in particular, to an antenna element used for multi-band antenna dual polarization.

BACKGROUND

Development of radio communication technologies is accompanied with more application of a multi-frequency multi-array antenna technology in the field of base station antennas. Although a system capacity can be significantly increased by using the multi-frequency multi-array antenna technology, as a quantity of scenarios in which elements on different frequency bands work collaboratively increases, radiating elements on different frequency bands are coupled electromagnetically and strongly when the radiating elements are arranged closely. Consequently, an antenna on a related frequency band cannot work normally due to such electromagnetic coupling.

In the prior art, during decoupling, a feeding structure of a base station antenna includes a decoupling circuit. That is, the feeding structure and the decoupling circuit are placed together. Therefore, in a resonance adjustment process, a working status of a radiating element is affected, and consequently electrical properties of the radiating element are affected. Moreover, in the prior art, an effect of decoupling between an element and a radiating element that are adjacent is improved by means of isolation. However, in this way, it is uneasy to implement, by using one PCB, a layout in which one radiating element corresponds to multiple elements, and manufacturability is poor.

SUMMARY

The present invention provides an antenna element used for multi-band antenna dual polarization, so as to reduce electromagnetic coupling between radiating elements and ensure normal working of an antenna.

A first aspect of embodiments of the present invention provides an antenna element used for multi-band antenna dual polarization, including:

four radiating elements (201), a balun element configured to feed power to the radiating elements (201), and a fastening plate (202) configured to fasten the balun element, where the balun element includes two dielectric plates (203), and the two dielectric plates (203) are embedded into each other in a crossing manner, two signal transmission units (301), one feeding unit, and two filtering units (402) are printed on each dielectric plate (203), and the filtering unit (402) is used for decoupling; and the two signal transmission units (301) are disposed on a first surface of each dielectric plate (203), top ends of the four signal transmission units (301) are electrically connected to bottom ends of the four radiating elements (201) respectively, the feeding unit is disposed on a second surface that is of each dielectric plate (203) and that is opposite to the first surface, and a bottom end of the feeding unit and bottom ends of the signal transmission units (301) are electrically connected to the fastening plate (202) separately.

With reference to the first aspect of the embodiments of the present invention, in a first implementation of the first aspect of the embodiments of the present invention, the two dielectric plates (203) are embedded into each other in a cross-shaped manner, and the two dielectric plates (203) are disposed in a vertically staggered manner; and a target gap (701) is provided on a side face, facing the balun element, of the fastening plate (202), and the target gap (701) is in a cross-shaped structure, so that the balun element can be inserted into the target gap (701), and the balun element is vertically fastened to the fastening plate (202) by using the target gap (701).

With reference to the first aspect of the embodiments of the present invention or the first implementation of the first aspect of the embodiments of the present invention, in a second implementation of the first aspect of the embodiments of the present invention, a gap structure is provided in a manner of passing through an intermediate location of each dielectric plate (203), so that the two dielectric plates (203) are embedded into each other in a crossing manner by using the gap structure;

the two signal transmission units (301) are respectively on two sides of the gap structure on the first surface of the dielectric plate (203); and the feeding unit is an L-shaped feeding sheet, and the feeding unit is on two sides and at a top end of the gap structure, or the feeding unit is at a bottom end of the gap structure.

With reference to the antenna element according to any one of the first aspect of the embodiments of the present invention to the second implementation of the first aspect of the embodiments of the present invention, in a third implementation of the first aspect of the embodiments of the present invention, the radiating elements (201) and the balun element are integrated into a whole, or the radiating elements (201) are detachably connected to the balun element.

With reference to the antenna element according to any one of the first aspect of the embodiments of the present invention to the third implementation of the first aspect of the embodiments of the present invention, in a fourth implementation of the first aspect of the embodiments of the present invention, the filtering unit (402) includes one filtering module; or each filtering unit (402) includes two or more filtering modules, and the filtering modules included in each filtering unit (402) are connected in parallel, or the filtering modules included in each filtering unit (402) are connected in series.

With reference to the fourth implementation of the first aspect of the embodiments of the present invention, in a fifth implementation of the first aspect of the embodiments of the present invention, the filtering module includes a first metal piece (901) and a second metal piece (902);

the first metal piece (901) is printed on the second surface of the dielectric plate (203), and the first metal piece (901) at least partially overlaps the signal transmission unit (301) in space; and the second metal piece (902) is disposed at a top end and/or a bottom end of the first metal piece (901), the second metal piece (902) and the first metal piece (901) are welded to each other, and the second metal piece (902) does not overlap the signal transmission unit (301) in space.

With reference to the fifth implementation of the first aspect of the embodiments of the present invention, in a sixth implementation of the first aspect of the embodiments of the present invention, when the second metal piece (902) is disposed at the top end of the first metal piece (901), the radiating element (201), the second metal piece (902), and the first metal piece (901) are successively disposed from top to bottom; and the filtering module is electrically connected to the radiating element (201), or the filtering unit (402) is electrically connected to the top end of the signal transmission unit (301).

With reference to the fifth implementation of the first aspect of the embodiments of the present invention, in a seventh implementation of the first aspect of the embodiments of the present invention, when the second metal piece (902) is disposed at the bottom end of the first metal piece (901), the radiating element (201), the first metal piece (901), and the second metal piece (902) are successively disposed from top to bottom; and the filtering module is electrically connected to the bottom end of the signal transmission unit (301), or the filtering module is electrically connected to the fastening plate (202).

With reference to the fifth implementation of the first aspect of the embodiments of the present invention, in an eighth implementation of the first aspect of the embodiments of the present invention, the filtering module includes two second metal pieces (902), and when the second metal pieces (902) are disposed at the top end and the bottom end of the first metal piece (901), the radiating element (201), one of the second metal pieces (902), the first metal piece (901), and the other second metal piece (902) are successively disposed from top to bottom; and the filtering module is electrically connected to the radiating element (201) and the fastening plate (202) separately; or the filtering module is electrically connected to the radiating element (201) and the bottom end of the signal transmission unit (301) separately; or the filtering module is electrically connected to the top end of the signal transmission unit (301) and the bottom end of the signal transmission unit (301) separately; or the filtering module is electrically connected to the top end of the signal transmission unit (301) and the fastening plate (202) separately.

With reference to the first aspect of the embodiments of the present invention, in a ninth implementation of the first aspect of the embodiments of the present invention, a length of each radiating element (201) is a quarter of a wavelength corresponding to center frequency of a signal; and a height of each dielectric plate (203) is a quarter of the wavelength corresponding to the center frequency of the signal.

With reference to the fifth implementation of the first aspect of the embodiments of the present invention, in a tenth implementation of the first aspect of the embodiments of the present invention, a length of each of the first metal piece (901) and the second metal piece (902) is between 0.1 time and once as long as a wavelength corresponding to resonance frequency of the signal.

The present invention provides the antenna element for multi-band antenna dual polarization. In the antenna element provided in the embodiments, the filtering unit is disposed on the balun element, an LC resonant energy storage structure is constructed by using the filtering unit, and decoupling on a specific frequency band can be implemented by adjusting the filtering units. Therefore, even if the antenna element provided in the embodiments is applied to a scenario in which elements on different frequency bands work collaboratively, radiating elements on different frequency bands are not coupled electromagnetically and strongly when the radiating elements are arranged closely, so that the antenna element provided in the embodiments can ensure normal working of an antenna on a related frequency band.

DESCRIPTION OF EMBODIMENTS

To better understand how an antenna element provided in embodiments of the present invention reduces electromagnetic coupling, detailed descriptions are provided below with reference to a specific application scenario.

Figure 1:
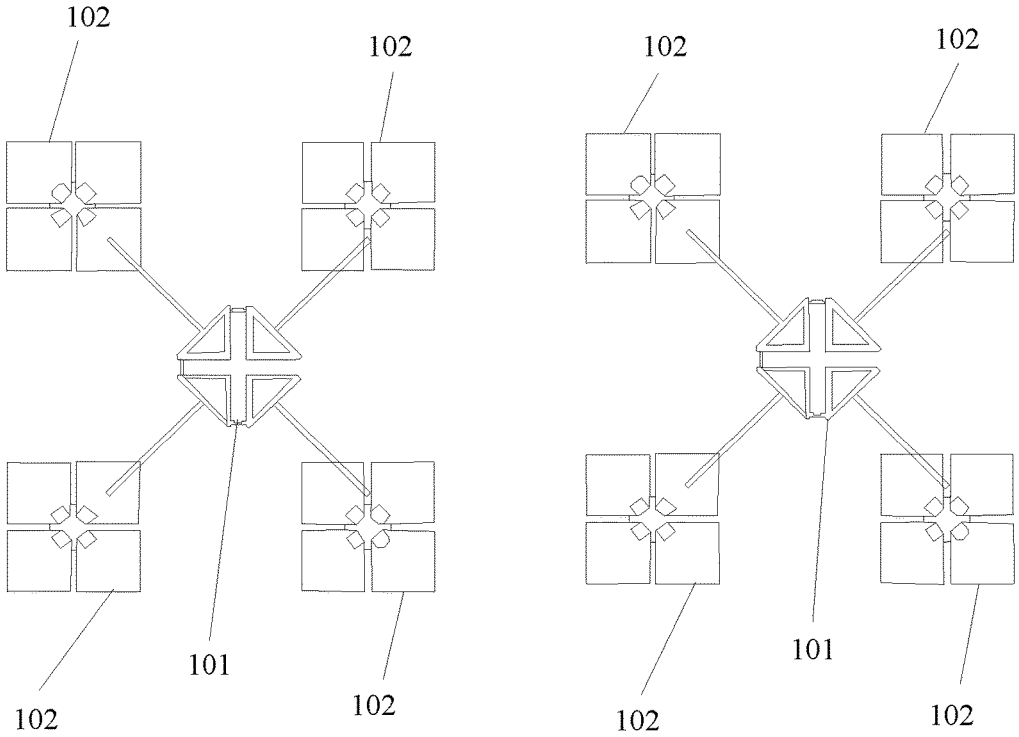
FIG. 1 is a schematic structural diagram of an application scenario to which an antenna element is applied.

As shown in FIG. 1, in this application scenario, there are two antenna elements 101 in an intermediate row, and radiating elements disposed on the antenna elements 101 are low-frequency radiating elements.

There are eight antenna elements 102 in two rows nearby the antenna elements 101, and radiating elements disposed on the antenna elements 102 are high-frequency radiating elements.

It can be learned that in this application scenario, because the high-frequency radiating elements and the low-frequency radiating elements are arranged closely, the high-frequency radiating elements are coupled electromagnetically and strongly to the low-frequency radiating elements. Consequently, an antenna element on a related frequency band cannot work normally due to such electromagnetic coupling. To reduce the foregoing electromagnetic coupling phenomenon, for a specific structure of an antenna element provided in the embodiments, refer to FIG. 2 first. The structure of the antenna element provided in the embodiments of the present invention is described below with reference to FIG. 2.

The antenna element includes: four radiating elements 201, a balun element configured to feed power to the radiating elements 201, and a fastening plate 202 configured to fasten the balun element.

Specifically, the balun element is disposed between the fastening plate 202 and the radiating elements 201.

More specifically, the balun element includes two dielectric plates 203.

Figure 2:
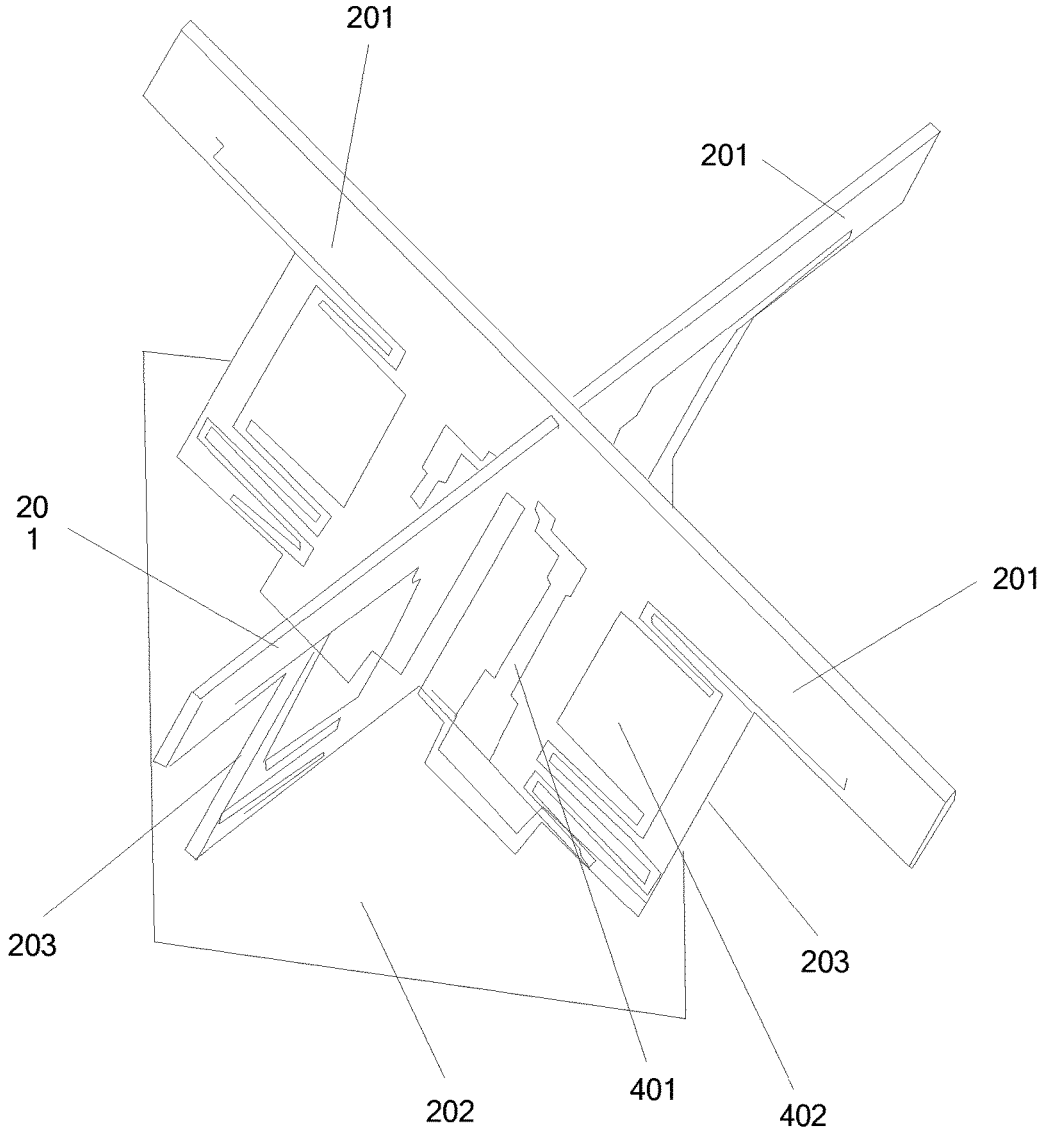
FIG. 2 is a schematic diagram of an integral structure of an embodiment of an antenna element used for multi-band antenna dual polarization according to the present invention.

It can be learned from FIG. 2 that the two dielectric plates 203 are embedded into each other in a crossing manner.

How the two dielectric plates 203 are specifically embedded into each other in a crossing manner is not limited in this embodiment, and an angle at which the two dielectric plates 203 cross is not limited in this embodiment.

Two signal transmission units, one feeding unit, and two filtering units are printed on each dielectric plate 203, and the filtering unit is used for decoupling.

A structure of the dielectric plate 203 is described below in detail with reference to FIG. 3 and FIG. 4. It should be noted that FIG. 3 and FIG. 4 show an example of the structure of the dielectric plate 203 and the example is not limited.

Figure 3:
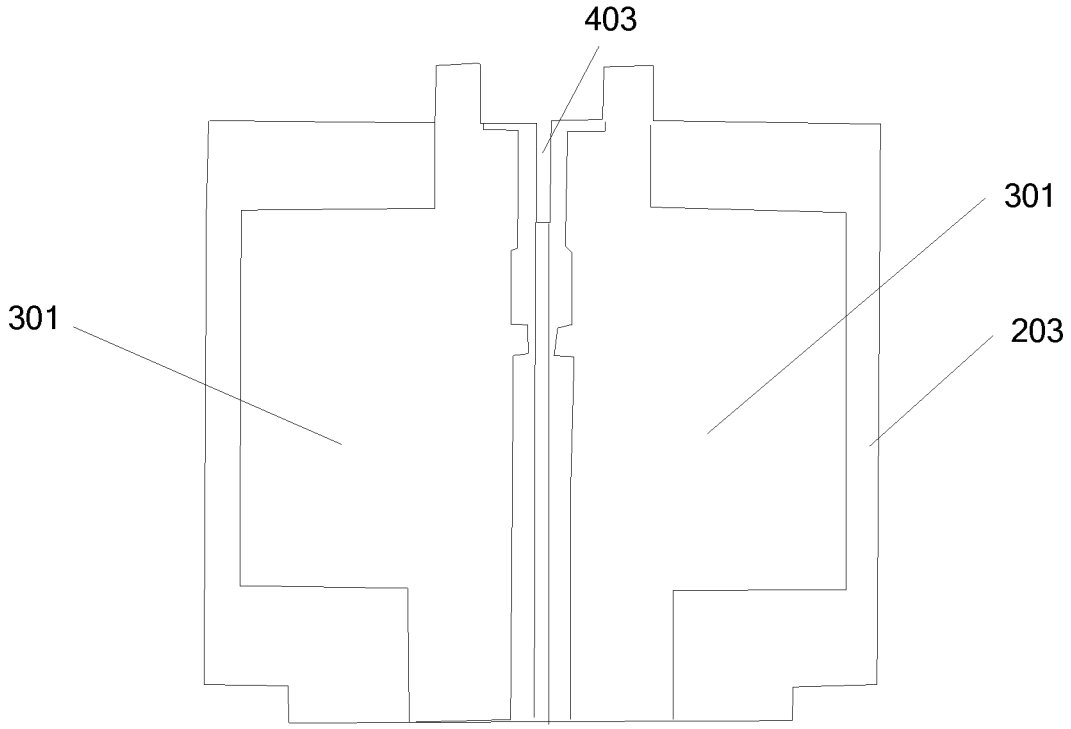
FIG. 3 is a schematic structural diagram of a first surface of an embodiment of a dielectric plate of the antenna element according to the present invention.
Figure 4:
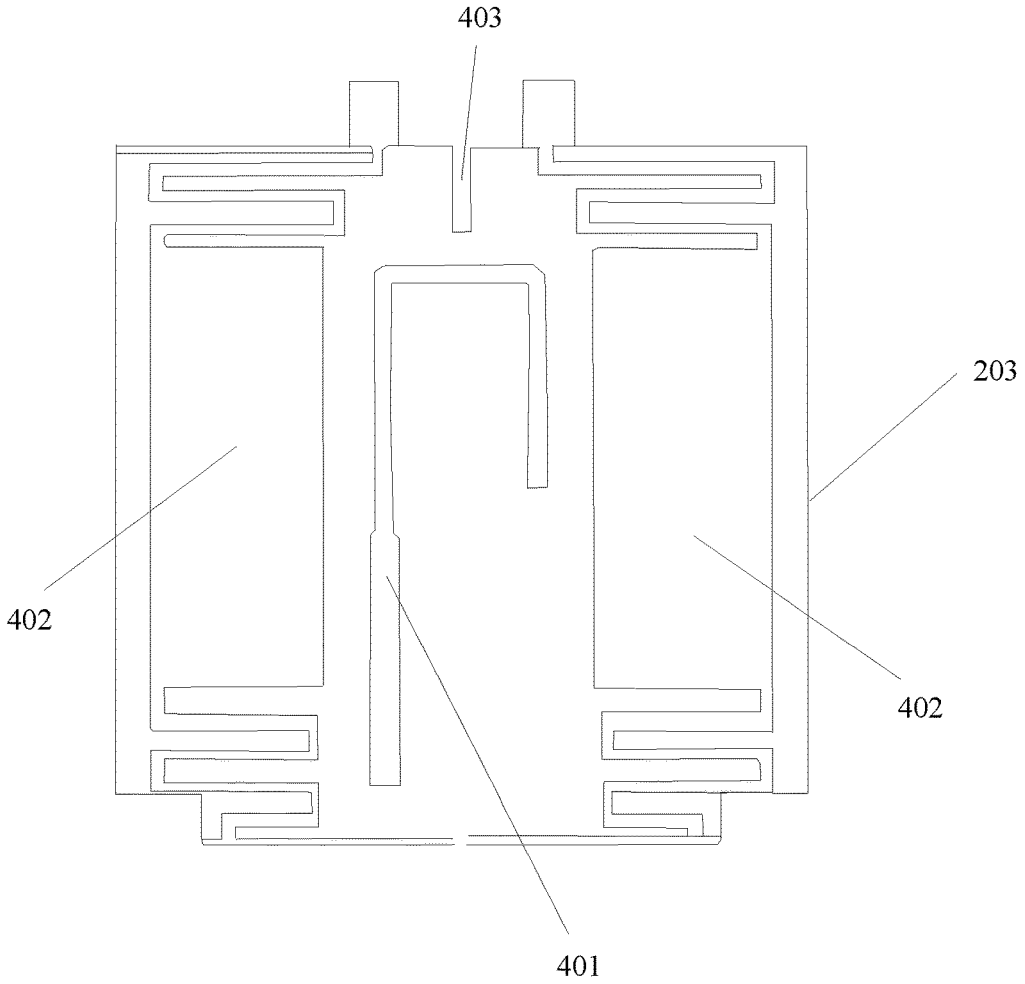
FIG. 4 is a schematic structural diagram of a second surface of an embodiment of a dielectric plate of the antenna element according to the present invention.

It can be learned from FIG. 3 that the two signal transmission units 301 are disposed on a first surface of each dielectric plate 203, that is, the two signal transmission units 301 are disposed on two sides on the first surface of the dielectric plate 203.

The balun element includes the two dielectric plates 203. Therefore, four signal transmission units 301 are disposed on the balun element in total, and top ends of the four signal transmission units 301 are electrically connected to bottom ends of the four radiating elements 201 respectively. For a connection structure in which the top ends of the signal transmission units 301 are electrically connected to the bottom ends of the radiating elements 201, refer to FIG. 2.

A structure of a second surface that is of each dielectric plate 203 and that is opposite to the first surface is described below with reference to FIG. 4.

One feeding unit 401 is disposed on the second surface that is of each dielectric plate 203 and that is opposite to the first surface, and a bottom end of the feeding unit 401 and the bottom ends of the signal transmission units 301 are electrically connected to the fastening plate 202 separately (as shown in FIG. 2).

The two filtering units 402 configured to reduce electromagnetic coupling between the radiating elements 201 are further disposed on the second surface of the dielectric plate 203.

A specific structure of the filtering unit 402 is not limited in this embodiment provided that the filtering unit 402 can reduce the electromagnetic coupling between the radiating elements 201.

A principle in which the filtering unit 402 provided in this embodiment can reduce the electromagnetic coupling between the radiating elements 201 is described below in detail with reference to FIG. 5.

For example, the radiating elements 201 disposed on the antenna element provided in this embodiment are high-frequency radiating elements.

In a multi-frequency multi-array environment, to reduce mutual coupling between a high-frequency radiating element and a low-frequency radiating element, an LC resonant energy storage structure is implemented on a balun element of the high-frequency radiating element; and energy that is sensed by the low-frequency radiating element from the high-frequency radiating element can be stored in the LC resonant energy storage structure and does not participate in radiation, so as to reduce mutual coupling between the high-frequency radiating element and the low-frequency radiating element.

Figure 5:
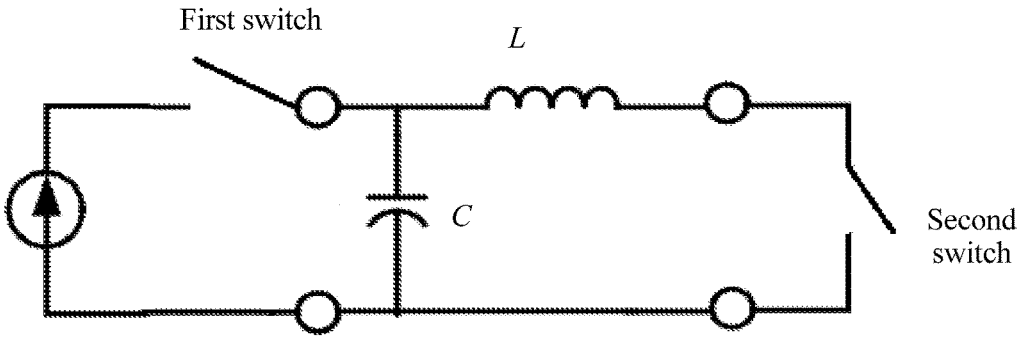
FIG. 5 is a circuit diagram of an embodiment of a principle of reducing electromagnetic coupling by the antenna element according to the present invention.

A specific principle of the LC resonant energy storage structure is shown in FIG. 5.

In a circuit shown in FIG. 5, a first switch is first connected, a second switch is disconnected, and a capacitor C is charged by using a voltage source. Then, the first switch is disconnected, and the second switch is connected. When it is assumed that there is no damping, energy stored in C is used for oscillation conversion between electric field energy and magnetic field energy in a circuit formed by connecting L and C in series and has no loss, and central oscillation frequency is $$f = \frac{1}{2\pi\sqrt{LC}}.$$

It can be learned that energy can be stored on a specific frequency band by adjusting sizes of L and C.

Specifically, in this embodiment of the present invention, the inductor L and the capacitor C can be simulated by using the filtering unit 402, the LC resonant energy storage structure is constructed on the balun element, and decoupling on the specific frequency band is implemented by adjusting the sizes of L and C.

It should be noted that when the radiating elements 201 disposed on the antenna element are low-frequency radiating elements, a decoupling principle thereof is the same as a decoupling principle used when the radiating elements 201 disposed on the antenna element are high-frequency radiating elements. Details are not described.

In this embodiment, the LC resonant energy storage structure is constructed by disposing the filtering unit 402 on the balun element of the antenna element, and decoupling on the specific frequency band can be implemented by adjusting the filtering unit. Therefore, even if the antenna element provided in this embodiment is applied to a scenario in which elements on different frequency bands work collaboratively, radiating elements on different frequency bands are not coupled electromagnetically and strongly when the radiating elements are arranged closely, so that the antenna element provided in this embodiment can ensure normal working of an antenna on a related frequency band.

How the two dielectric plates 203 specifically are embedded into each other in a crossing manner is described below in detail with reference to the accompanying drawings. It should be noted that a crossing and embedding manner of the two dielectric plates 203 is an example in this embodiment and is not limited.

Figure 6:
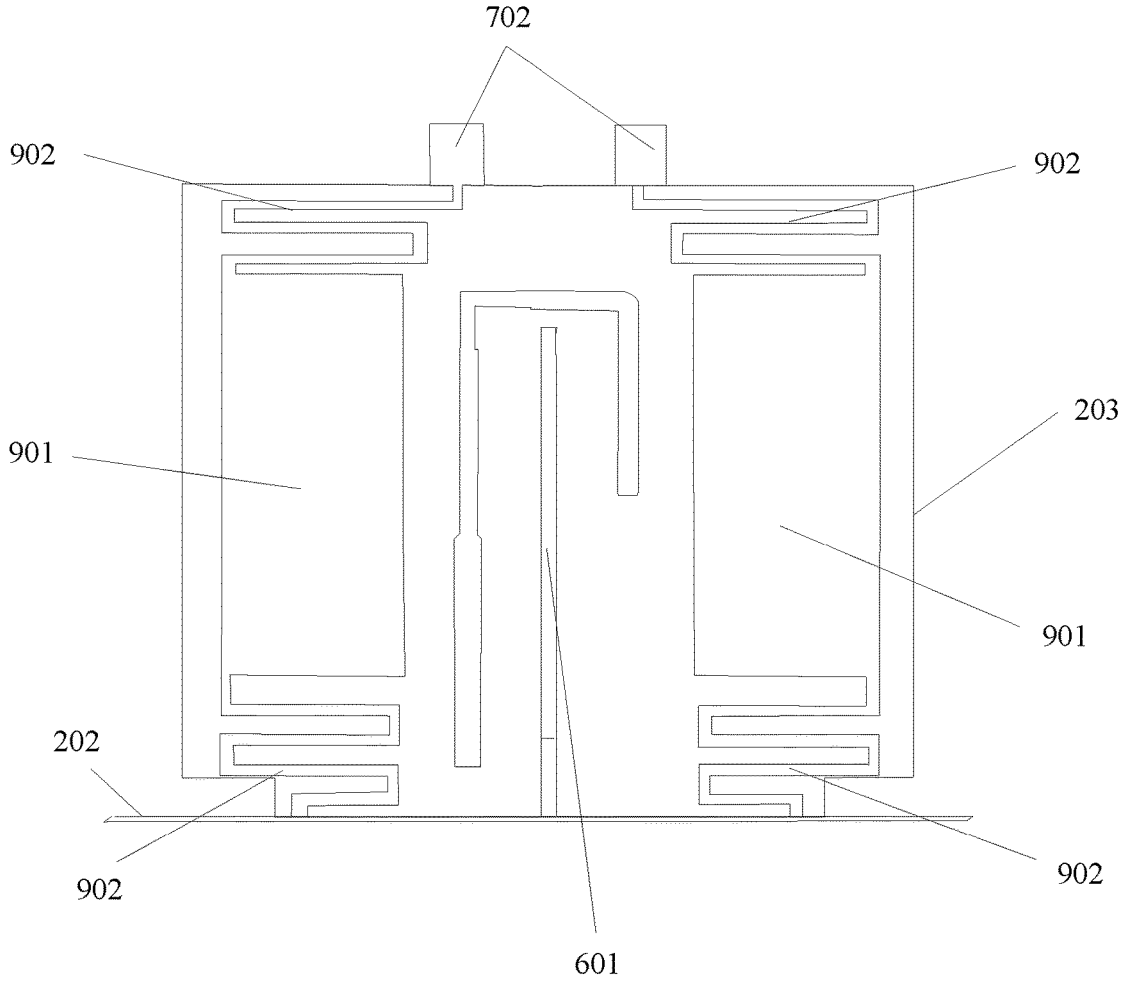
FIG. 6 is a schematic structural diagram of a second surface of another embodiment of a dielectric plate of the antenna element according to the present invention.

FIG. 4 and FIG. 6 are used as an example. In the two dielectric plates 203 that form the balun element shown in this embodiment, one dielectric plate 203 is shown in FIG. 4, and the other dielectric plate 203 is shown in FIG. 6.

A gap structure is provided in a manner of passing through an intermediate location of each dielectric plate 203.

The gap structure is used to enable the two dielectric plates 203 to be embedded into each other in a crossing manner by using the gap structure.

That is, for the gap structure 403 shown in FIG. 4 and the gap structure 601 shown in FIG. 6, it can be learned that in the two dielectric plates 203 configured to form one balun element, a gap structure of one of the dielectric plates 203 is longer, as shown in FIG. 6, and a gap structure of the other dielectric plate 203 is shorter, as shown in FIG. 4.

The two dielectric plates 203 can be embedded into each other by matching each other and by using the gap structure 403 and the gap structure 601 that correspond to each other, so that the two dielectric plates 203 are disposed in a vertically staggered manner.

Preferably, for a structure in which the two dielectric plates 203 are embedded into each other by using the gap structures, refer to FIG. 2. It can be learned from FIG. 2 that an included angle between the two dielectric plates 203 is 90 degrees. It should be noted that the included angle between the two dielectric plate 203 being 90 degrees is an example, so that the antenna element has a fine dual-polarization feature and resists multi-path interference, a call loss is reduced, interference is reduced, and the like.

It should be noted that, in an example of this embodiment, the included angle between the two dielectric plates 203 is 90 degrees, and is not limited.

Lengths of the gap structures of the two dielectric plates 203 are different. Therefore, structures of the feeding units 401 disposed on the dielectric plates 203 are different.

Shapes of the feeding units 401 disposed on the dielectric plates 203 may be the same. In this embodiment, optionally, the feeding unit 401 is an L-shaped feeding sheet.

Certainly, the shape of the feeding unit 401 is an example in this embodiment, and is not limited.

The feeding units 401 are disposed at different locations on the dielectric plates 203.

As shown in FIG. 4, when the gap structure 403 of the dielectric plate 203 is shorter, the feeding unit 401 is at a bottom end of the gap structure 403.

As shown in FIG. 6, when the gap structure 601 of the dielectric plate 203 is longer, the feeding unit 401 is on two sides of the gap structure 601 and at a top end of the gap structure 601.

It can be learned that because the two dielectric plates 203 are embedded into each other in a crossing manner and are disposed in a vertically staggered manner, the feeding unit 401 shown in FIG. 4 is at a lower location, and the feeding unit 601 shown in FIG. 6 is at a higher location, so that the feeding unit 401 and the feeding unit 601 are disposed in a vertically staggered manner.

The signal transmission units 301 may be disposed, in a same manner, on the two dielectric plates 203 configured to form one balun element. The manner of disposing the signal transmission units 301 is described in this embodiment by using FIG. 3 as an example.

It can be learned from FIG. 3 that, the two signal transmission units 301 are respectively located on two sides of the gap structure 403 on the first surface of the dielectric plate 203.

Specifically, the signal transmission unit 301 may be a metal patch, and covers a relatively large area on the two sides of the gap structure 403 on the first surface of the dielectric plate 203.

FIG. 3 is a schematic structural diagram of the first surface of the dielectric plate 203 when the gap structure 403 is shorter. It should be noted that when the gap structure is longer, the signal transmission units 301 are disposed at same locations as those shown in FIG. 3. Details are not described.

How to fasten the balun element in this embodiment to the fastening plate 202 is described below with reference to FIG. 7.

A target gap 701 is provided on a side face, facing the balun element, of the fastening plate 202.

The target gap 701 is in a cross-shaped structure. That is, the foregoing two dielectric plates 203 that are embedded into each other can be inserted into the target gap 701, so that the balun element can be inserted into the target gap 701, and the balun element is vertically fastened to the fastening plate 202 by using the target gap 701.

It should be noted that descriptions of fastening the balun element to the fastening plate 202 in this embodiment are an example, and are not limited.

A structure relationship between the balun element and the radiating elements 201 is described below with reference to the accompanying drawings.

In one structure relationship shown in FIG. 2, the radiating elements 201 and the balun element are integrated into a whole.

Figure 8:
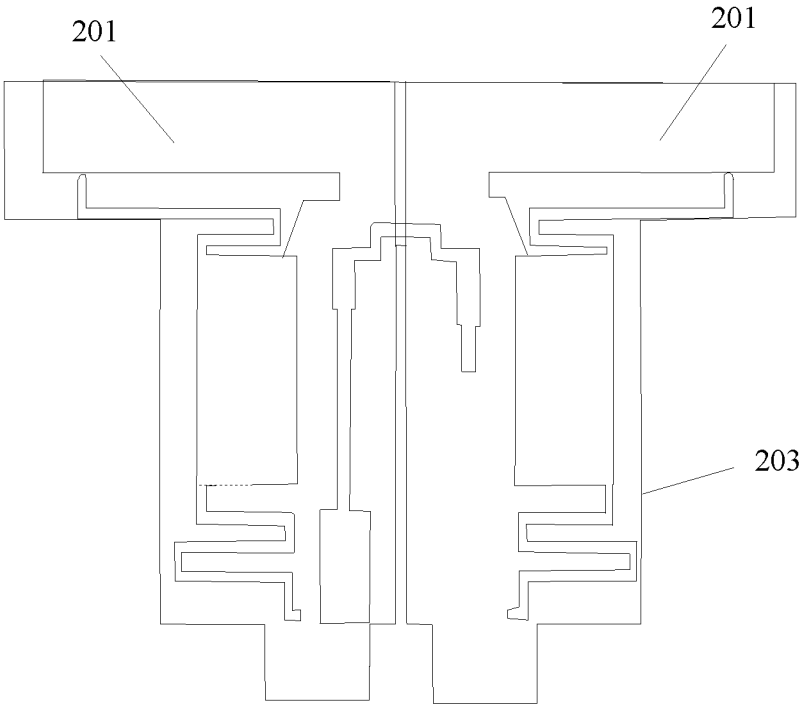
FIG. 8 is a schematic structural diagram of a second surface of another embodiment of a dielectric plate of the antenna element according to the present invention.

Further referring to FIG. 8, FIG. 8 is a schematic structural diagram of the second surface of the dielectric plate 203 when the radiating elements 201 and the balun element are integrated into a whole.

It can be learned from FIG. 8 that two of the radiating elements 201 are disposed at the top end of the dielectric plate 203, so that the radiating elements 201 and the balun element are integrated into a whole.

Figure 7:
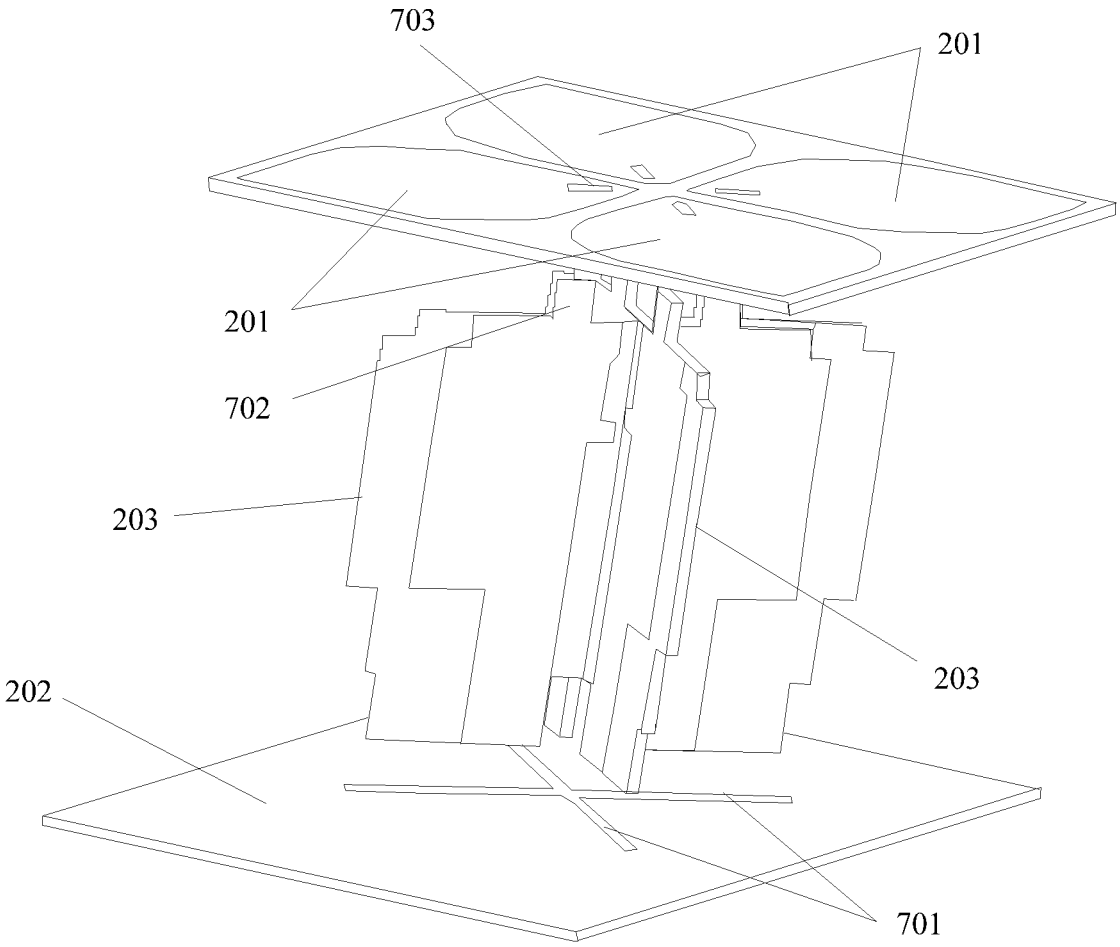
FIG. 7 is a schematic structural diagram of an explosive connection of an embodiment of an antenna element used for multi-band antenna dual polarization according to the present invention.

In another structure relationship shown in FIG. 7, the radiating elements 201 are detachably connected to the balun element.

Specifically, a limiting convex portion 702 is disposed at the top end of the dielectric plate 203. For a specific disposing location of the limiting convex portion 702, further refer to FIG. 6.

A limiting slot 703 is disposed at a location, corresponding to the limiting convex portion 702, on the radiating element 201, so that the limiting convex portion 702 can be inserted into and fastened to the limiting slot 703, and the radiating element 201 can be detachably connected to the dielectric plate 203.

It should be noted that descriptions of the structure relationship between the balun element and the radiating elements 201 in this embodiment are an example, and are not limited provided that the balun element can feed power to the radiating elements 201.

A specific disposing manner of the filtering unit 402 and an electrical connection relationship between components of the antenna element are described below in detail with reference to the accompanying drawings.

Each filtering unit 402 includes one filtering module; or each filtering unit 402 includes two or more filtering modules, and the filtering modules included in each filtering unit are connected in parallel, or the filtering modules included in each filtering unit 402 are connected in series.

First, for example, each filtering unit 402 includes one filtering module.

There are multiple cases for a disposing manner of the filtering module in this embodiment.

Figure 9:
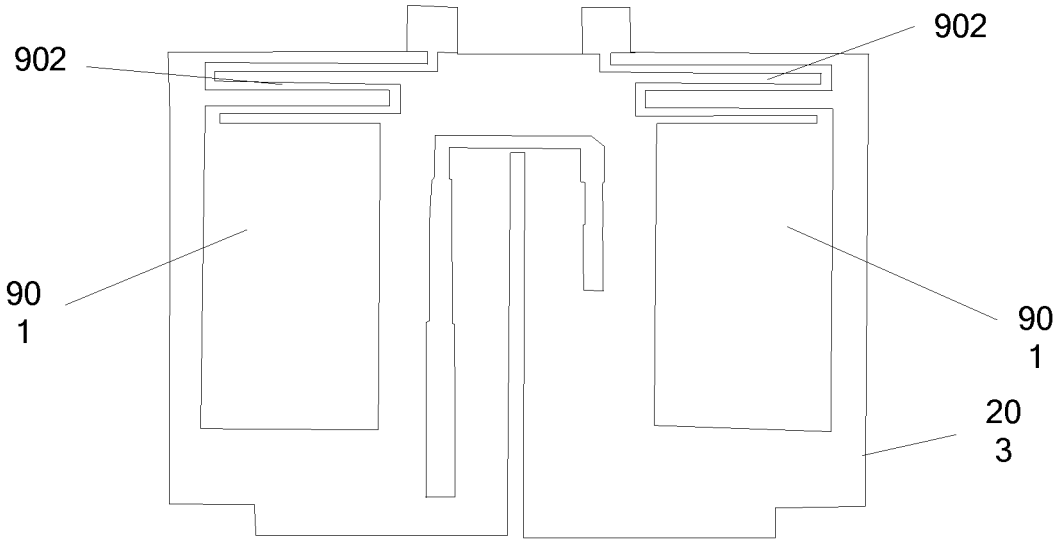
FIG. 9 is a schematic structural diagram of a second surface of another embodiment of a dielectric plate of the antenna element according to the present invention.

For a first case, refer to FIG. 9.

The filtering module includes a first metal piece 901 and a second metal piece 902.

The first metal piece 901 is printed on the second surface of the dielectric plate 203.

Specifically, the first metal piece 901 at least partially overlaps the signal transmission unit 301 in space. That is, the first metal piece 901 at least partially overlaps the signal transmission unit 301 while the first metal piece 901 and the signal transmission unit 301 are spaced by the dielectric plate 203.

Moreover, the first metal piece 901 is in a metal patch structure and is printed on the second surface of the dielectric plate 203. A specific shape of the first metal piece 901 is not limited in this embodiment.

In this embodiment, the capacitor C in the LC resonant energy storage structure shown in FIG. 1 is simulated by using the first metal piece 901 with a large area. For a specific structure and the principle that are of the LC resonant energy storage structure, refer to the foregoing descriptions. Details are not described herein again.

When the size of the capacitor C simulated by using the first metal piece 901 is adjusted, an area in which the first metal piece 901 and the signal transmission unit 301 overlap in space may be adjusted. That is, because areas in which the first metal pieces 901 and the signal transmission units 301 overlap in space are different, the first metal pieces 901 can simulate sizes of different capacitors C.

The second metal piece 902 is disposed at a top end of the first metal piece 901.

Specifically, the second metal piece 902 and the first metal piece 901 are welded to each other, and the second metal piece 902 does not overlap the signal transmission unit 301 in space.

As shown in FIG. 9, the second metal piece 902 is in a metal thin line structure, and is disposed in a bended manner.

An area of the second metal piece 902 is smaller than an area of the first metal piece 901.

In this embodiment, the inductor L in the LC resonant energy storage structure shown in FIG. 1 is simulated by using the second metal piece 902 that has a small area and that is in the thin line structure. For the specific structure and the principle that are of the LC resonant energy storage structure, refer to the foregoing descriptions. Details are not described herein again.

When the size of the inductor L simulated by using the second metal piece 902 is adjusted, the area of the second metal piece 902 may be adjusted. That is, because areas of the second metal pieces 902 are different, the second metal pieces 902 can simulate sizes of different inductors L.

An electrical connection relationship, of the filtering module, that exists when the second metal piece 902 is disposed at the top end of the first metal piece 901 is described below.

First, in a space structure, the radiating element 201, the second metal piece 902, and the first metal piece 901 are successively disposed from top to bottom.

In an electrical connection structure, the filtering module is electrically connected to the radiating element 201.

Specifically, a top end of the second metal piece 902 is electrically connected to the radiating element 201, and a bottom end of the second metal piece 902 is electrically connected to the top end of the first metal piece 901.

Figure 10:
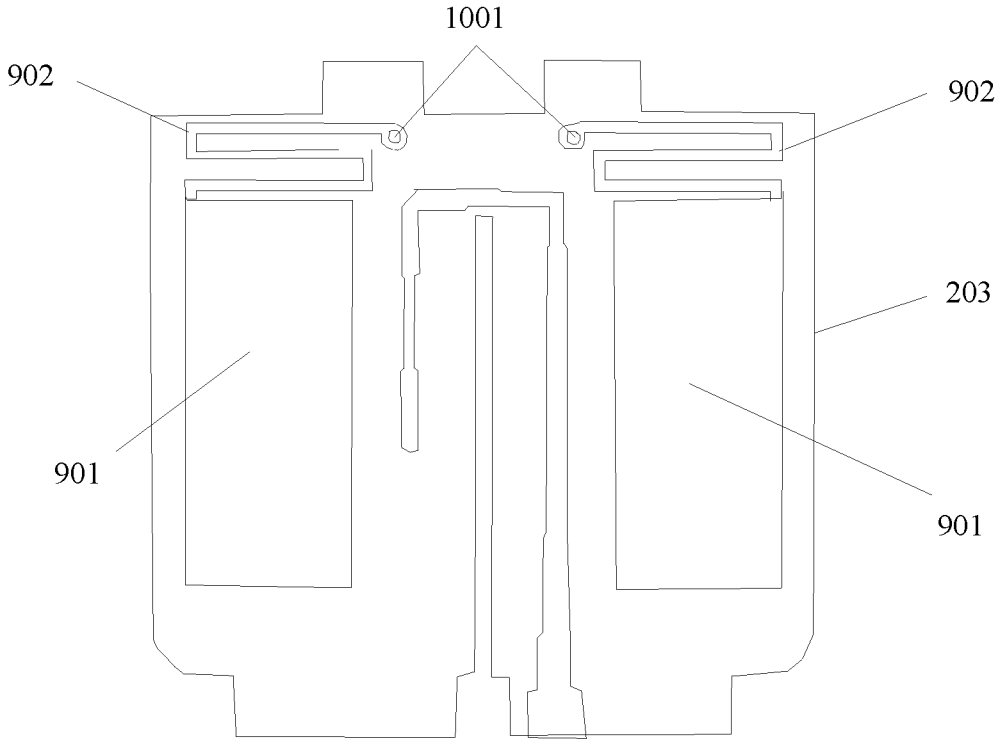
FIG. 10 is a schematic structural diagram of a second surface of another embodiment of a dielectric plate of the antenna element according to the present invention.

For a second case, refer to FIG. 10.

A specific disposing manner and disposing locations, shown in FIG. 10, of the first metal piece 901 and the second metal piece 902 are the same as those shown in FIG. 9. Details are not described herein again. A difference between the filtering module shown in FIG. 10 and the filtering module shown in FIG. 9 is that the filtering modules are in different electrical connection structures.

In the electrical connection structure of the filtering module shown in FIG. 10, the filtering unit is electrically connected to the top end of the signal transmission unit 301.

Specifically, a plated hole 1001 is disposed at the top end of the dielectric plate 203, so that a top end of the second metal piece 902 can pass through the plated hole 1001 to be electrically connected to the top end of the signal transmission unit 301.

The bottom end of the second metal piece 902 is electrically connected to the top end of the first metal piece 901.

Figure 11:
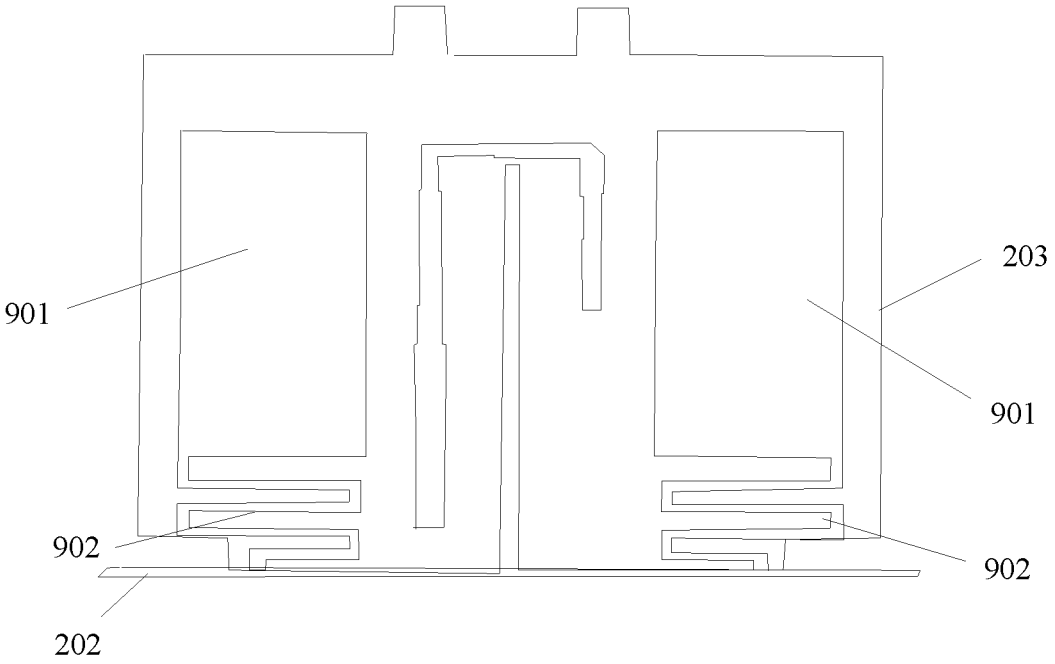
FIG. 11 is a schematic structural diagram of a second surface of another embodiment of a dielectric plate of the antenna element according to the present invention.

For a third case, refer to FIG. 11.

For a disposing manner, shown in FIG. 11, of the first metal piece 901 and the second metal piece 902, refer to FIG. 9. Details are not described herein again. Disposing locations and electrical connection structures, shown in FIG. 11, of the first metal piece 901 and the second metal piece 902 are different from those shown in FIG. 9.

It can be learned from FIG. 11 that the second metal piece 902 is disposed at a bottom end of the first metal piece 901.

An electrical connection relationship, of the filtering module, that exists when the second metal piece 902 is disposed at the bottom end of the first metal piece 901 is described below.

First, in a space structure, the radiating element 201, the first metal piece 901, and the second metal piece 902 are successively disposed from top to bottom.

In an electrical connection structure, the filtering module is electrically connected to the fastening plate 202.

Specifically, the bottom end of the first metal piece 901 is electrically connected to a top end of the second metal piece 902.

A bottom end of the second metal piece 902 is electrically connected to the fastening plate 202.

In a fourth case, a specific disposing manner and disposing locations of the first metal piece 901 and the second metal piece 902 are the same as those shown in FIG. 11. Details are not described herein again. A difference between the filtering module in this disposing manner and the filtering module shown in FIG. 11 is that the filtering modules are in different electrical connection structures.

In this disposing manner, the filtering module is electrically connected to the bottom end of the signal transmission unit 301.

Specifically, a plated hole is disposed at the bottom end of the dielectric plate 203 (For a specific disposing manner of the plated hole, refer to FIG. 9, and details are not described again in this disposing manner), so that the bottom end of the second metal piece 902 can pass through the plated hole to be electrically connected to the bottom end of the signal transmission unit 301.

For a fifth case, refer to FIG. 6.

A specific disposing manner, shown in FIG. 6, of the first metal piece 901 and the second metal piece 902 is the same as that shown in FIG. 9. Details are not described herein again. A difference between the filtering module shown in FIG. 6 and the filtering module shown in FIG. 9 is that the filtering modules are disposed at different locations and are in different electrical connection structures.

As shown in FIG. 6, the filtering module includes two second metal pieces 902, and the second metal pieces 902 are disposed at a top end and a bottom end of the first metal piece 901.

An electrical connection relationship, of the filtering module, that exists when the second metal pieces 902 are disposed at the top end and the bottom end of the first metal piece 901 is described below.

First, in a space structure, the radiating element 201, one of the second metal pieces 902, the first metal piece 901, and the other second metal piece 902 are successively disposed from top to bottom.

In an electrical connection structure, the filtering module is electrically connected to the radiating element 201 and the fastening plate 202 separately.

Specifically, two ends of the one second metal piece 902 at the top end of the dielectric plate 203 are electrically connected to the radiating element 201 and the top end of the first metal piece 901 separately.

Two ends of the one second metal piece 902 at the bottom end of the dielectric plate 203 are electrically connected to the bottom end of the first metal piece 901 and the fastening plate 202 respectively.

In a sixth case, a specific disposing manner and disposing locations of the first metal piece 901 and the second metal piece 902 are the same as those shown in FIG. 6. Details are not described herein again. A difference between the filtering module in this disposing manner and the filtering module shown in FIG. 6 is that the filtering modules are in different electrical connection structures.

In this disposing manner, the filtering module is electrically connected to the radiating element 201 and the bottom end of the signal transmission unit 301 separately.

Specifically, two ends of the one second metal piece 902 at the top end of the dielectric plate 203 are electrically connected to the radiating element 201 and a top end of the second metal piece 902 separately.

Two ends of the one second metal piece 902 at the bottom end of the dielectric plate 203 are electrically connected to a bottom end of the first metal piece 901 and the bottom end of the signal transmission unit 301 respectively.

More specifically, a plated hole is disposed at the bottom end of the dielectric plate 203, so that the bottom end of the second metal piece 902 can pass through the plated hole to be electrically connected to the bottom end of the signal transmission unit 301.

In this embodiment, the plated hole is provided at the bottom end of the dielectric plate 203.

In a seventh case, a specific disposing manner and disposing locations of the first metal piece 901 and the second metal piece 902 are the same as those shown in FIG. 6. Details are not described herein again. A difference between the filtering module in this disposing manner and the filtering module shown in FIG. 6 is that the filtering modules are in different electrical connection structures.

In this disposing manner, the filtering module is electrically connected to the top end of the signal transmission unit 301 and the bottom end of the signal transmission unit 301 separately.

Specifically, two ends of the one second metal piece 902 at the top end of the dielectric plate 203 are electrically connected to the top end of the signal transmission unit 301 and a top end of the first metal piece 901 respectively.

A plated hole is disposed at the top end of the dielectric plate 203, so that the second metal piece 902 can pass through the plated hole to be electrically connected to the top end of the signal transmission unit 301.

Two ends of the one second metal piece 902 at the bottom end of the dielectric plate 203 are electrically connected to a bottom end of the first metal piece 901 and the bottom end of the signal transmission unit 301 respectively.

A plated hole is disposed at the bottom end of the dielectric plate 203, so that the second metal piece 902 can pass through the plated hole to be electrically connected to the bottom end of the signal transmission unit 301.

In an eighth case, a specific disposing manner and disposing locations of the first metal piece 901 and the second metal piece 902 are the same as those shown in FIG. 6. Details are not described herein again. A difference between the filtering module in this disposing manner and the filtering module shown in FIG. 6 is that the filtering modules are in different electrical connection structures.

In this disposing manner, the filtering module is electrically connected to the top end of the signal transmission unit 301 and the fastening plate 202 separately.

Specifically, two ends of the one second metal piece 902 at the top end of the dielectric plate 203 are electrically connected to the top end of the signal transmission unit 301 and a top end of the first metal piece 901 respectively.

A plated hole is disposed at the top end of the dielectric plate 203, so that the second metal piece 902 can pass through the plated hole to be electrically connected to the top end of the signal transmission unit 301.

Two ends of the one second metal piece 902 at the bottom end of the dielectric plate 203 are electrically connected to a bottom end of the first metal piece 901 and the fastening plate 202 respectively.

In the following example for description, the filtering unit 402 includes multiple filtering modules.

Figure 12:
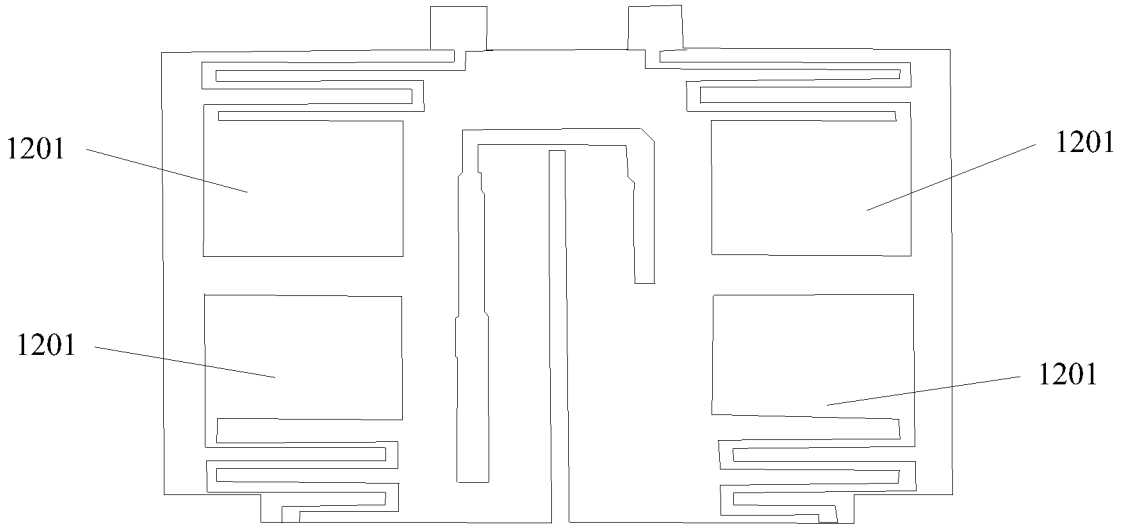
FIG. 12 is a schematic structural diagram of a second surface of another embodiment of a dielectric plate of the antenna element according to the present invention.

As shown in FIG. 12, each filtering unit 402 includes two filtering modules. It should be noted that each filtering unit 402 may include more than two filtering modules. FIG. 12 is only an example.

As shown in FIG. 12, the filtering modules 1201 included in each filtering unit are connected in parallel.

For a specific disposing manner, a disposing location, and an electrical connection structure that are of each filtering module 1201, refer to the foregoing embodiments. Details are not described in this embodiment provided that the filtering modules 1201 included in each filtering unit are connected in parallel.

Certainly, that the filtering modules 1201 included in each filtering unit are connected in parallel is an example. Alternatively, the filtering modules included in each filtering unit may be connected in series. Details are not described.

It should be noted that the foregoing descriptions of the filtering modules are an example, and are not limited provided that the filtering modules can reduce mutual coupling between a high-frequency radiating element and a low-frequency radiating element.

In this embodiment, the inductor L is simulated by using the second metal piece 902, the capacitor C is simulated by using the first metal piece 901, the LC resonant energy storage structure shown in FIG. 1 is constructed on the balun element, and then the sizes of L and C are adjusted to implement decoupling on a specific frequency band, so as to reduce mutual coupling between the high-frequency radiating element and the low-frequency radiating element. Therefore, radiation indicators of the high-frequency radiating element and the low-frequency radiating element are effectively increased.

Sizes of components of the antenna element are described below. It should be noted that the sizes of the components of the antenna element in this embodiment are an example, and are not limited provided that coupling between the high-frequency radiating element and the low-frequency radiating element is reduced.

A length of each radiating element 201 is a quarter of a wavelength corresponding to center frequency of a signal.

A height of each dielectric plate 203 is a quarter of the wavelength corresponding to the center frequency of the signal.

A length of each of the first metal piece and the second metal piece is between 0.1 time and once as long as a wavelength corresponding to resonance frequency of the signal.

The signal is a signal radiated by the antenna element provided in this embodiment of the present invention.

It may be clearly understood by persons skilled in the art that, for the purpose of convenient and brief description, for a detailed working process of the foregoing system, apparatus, and unit, refer to a corresponding process in the foregoing method embodiments, and details are not described herein again.

The foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. An antenna element used for multi-band antenna dual polarization, comprising: four radiating elements, a balun element configured to feed power to the radiating elements, and a fastening plate configured to fasten the balun element, wherein the balun element comprises two dielectric plates, the two dielectric plates being embedded into each other in a crossing manner, two signal transmission units, one feeding unit, and two filtering units printed on each dielectric plate (203), the filtering units being used for decoupling; and, wherein each of the filtering units comprises one or more filtering modules, wherein the one or more filtering modules are connected in parallel or in series, wherein a given one of the one or more filtering modules comprises a first metal piece and a second metal piece, wherein the first metal piece is printed on the second surface of the dielectric plate, and the first metal piece at least partially overlaps the signal transmission unit in space; and the second metal piece is disposed at a top end and/or a bottom end of the first metal piece, the second metal piece and the first metal piece are welded to each other, and the second metal piece does not overlap the signal transmission unit in space; and the two signal transmission units are disposed on a first surface of each dielectric plate, wherein top ends of the four signal transmission units are electrically connected to bottom ends of the four radiating elements respectively, the feeding unit being disposed on a second surface that is of each dielectric plate and that is opposite to the first surface, and a bottom end of the feeding unit and bottom ends of the signal transmission units are electrically connected to the fastening plate separately.

2. The antenna element according to claim 1, wherein the two dielectric plates are embedded into each other in a cross-shaped manner, and the two dielectric plates are disposed in a vertically staggered manner; and a target gap is provided on a side face, facing the balun element, of the fastening plate, wherein the target gap is in a cross-shaped structure, so that the balun element can be inserted into the target gap, and the balun element is vertically fastened to the fastening plate by using the target gap.

3. The antenna element according to claim 1, wherein a gap structure is provided in a manner of passing through an intermediate location of each dielectric plate, so that the two dielectric plates are embedded into each other in a crossing manner by using the gap structure;

the two signal transmission units are respectively on two sides of the gap structure on the first surface of the dielectric plate; and the feeding unit is an L-shaped feeding sheet, and the feeding unit is on two sides and at a top end of the gap structure, or the feeding unit is at a bottom end of the gap structure.

4. The antenna element according to claim 1, wherein the radiating elements and the balun element are integrated into a whole, or the radiating elements are detachably connected to the balun element.

5. The antenna element according to claim 1, wherein when the second metal piece is disposed at the top end of the first metal piece, the radiating element, the second metal piece, and the first metal piece are successively disposed from top to bottom; and the filtering module is electrically connected to the radiating element, or the filtering unit is electrically connected to the top end of the signal transmission unit.

6. The antenna element according to claim 1, wherein when the second metal piece is disposed at the bottom end of the first metal piece, the radiating element, the first metal piece, and the second metal piece are successively disposed from top to bottom; and the filtering module is electrically connected to the bottom end of the signal transmission unit, or the filtering module is electrically connected to the fastening plate.

7. The antenna element according to claim 1, wherein the filtering module comprises two second metal pieces, and when the second metal pieces are disposed at the top end and the bottom end of the first metal piece, the radiating element (201), one of the second metal pieces, the first metal piece, and the other second metal piece are successively disposed from top to bottom; and the filtering module is electrically connected:

to the radiating element and the fastening plate separately;

to the radiating element and the bottom end of the signal transmission unit separately;

to the top end of the signal transmission unit and the bottom end of the signal transmission unit separately; or to the top end of the signal transmission unit and the fastening plate separately.

8. The antenna element according to claim 1, wherein a length of each radiating element is a quarter of a wavelength corresponding to center frequency of a signal; and a height of each dielectric plate is a quarter of the wavelength corresponding to the center frequency of the signal.

9. The antenna element according to claim 1, wherein a length of each of the first metal piece and the second metal piece is between 0.1 time and once as long as a wavelength corresponding to resonance frequency of the signal.

* * * * *